United States Patent [19]

Thurston

[11] Patent Number: 4,878,447

[45] Date of Patent: Nov. 7, 1989

[54] MULTIHULL VESSELS

[76] Inventor: John W. Thurston, 5313 S. 12th, Arlington, Va. 22204

[21] Appl. No.: 132,068

[22] Filed: Dec. 11, 1987

Related U.S. Application Data

[63] Continuation-in-part of Ser. No. 27,208, Mar. 24, 1987, abandoned, which is a continuation of Ser. No. 751,382, Jul. 3, 1985, abandoned.

[51] Int. Cl.[4] ..... B63B 43/14

[52] U.S. Cl. ..... 114/61; 114/39.1; 114/123

[58] Field of Search ..... 114/39.1, 89, 90, 91, 114/93, 123, 283, 61

[56] References Cited

U.S. PATENT DOCUMENTS 4,159,006 6/1979 Thurston ..... 114/123

4,474,128 10/1984 Wallach ..... 114/123

*Primary Examiner*—Joseph F. Peters, Jr.

*Assistant Examiner*—Edwin L. Swinehart

*Attorney, Agent, or Firm*—Burns, Doane, Swecker & Mathis

[57] ABSTRACT

A multi-hull vessel has a center section and a plurality of float arm assemblies disposed on opposite sides of the center section. The float arm assemblies are pivoted so as to be movable upwardly or downwardly. Each float arm assembly comprises upper and lower arm arrangements, each including inner and outer segments joined by a pivot. The outer segment of the lower arm arrangement includes a float. To raise the arms assembly, a rigging line is provided which extends from the center section to the outer segment of lower arm arrangement and is disposed above the intermediate pivot of the lower arm arrangement and below the intermediate pivot of the upper arm arrangement. The rigging line is oriented to produce a lifting force on the lower arm arrangement having a larger component in horizontal direction than in the vertical direction.

29 Claims, 9 Drawing Sheets

MULTIHULL VESSELS

RELATED APPLICATIONS

This is a Continuation-in-Part of now-abandoned U.S. Ser. No. 07/027,208 filed March 24, 1987 which, in turn, is a Continuation of now-abandoned U.S. Ser. No. 06/751,382 filed Jul. 3, 1985.

BACKGROUND OF THE INVENTION

This invention relates to multihull vessels having a center section, which may be a cabin or other superstructure with or without an attached hull, a pair of outrigger hulls (hereinafter referred to as floats) oppositely spaced from the center section on pivotally mounted and jointed arms or outriggers (hereinafter referred to as float arms), and one or more masts mounted on the center section.

In contrast to a self-righting monohull vessel which maintains stability by having its center of gravity arranged below its center of buoyancy, a multihull vessel provides buoyancy to oppose heeling in the form of divided hulls or outrigger floats. A monohull sailboat with ballasted keel has no righting moment at 0 degrees of heel where heeling moment is maximum, has maximum righting moment at 90 degrees of heel where heeling moment on the sailplan vanishes and is unstable at 180 degrees of heel. A multihull vessel has large initial stiffness or resistance to heeling due to the lateral displacement of the center of buoyancy, but the righting moment decreases as the angle of heel increases while more of the bottom of the vessel is exposed to the forces of wind, and the vessel is more stable at 180 degrees of heel than at 0 degrees unless additional buoyancy is provided above the center of gravity of the upright vessel. Unless the beam of the vessel can be reduced, a very large righting moment is required, usually in the form of unavailable external leverage, to bring the vessel back past 90 degrees of heel.

A solution to the problem of multihull capsizing, comprising means for placing movable outrigger floats beneath and within the cross-sectional extent of the center section of the capsized vessel, thereby rendering the vessel unstable in a capsized position, is provided in U.S. Pat. No. 4,159,006 issued 26 Jun. 1979 and U.S. Pat. No. 4,457,248 issued 3 Jul. 1984, both to this inventor. In addition to providing a method for righting a capsized multihull vessel inherently superior to any disclosed in the prior art, the inventions described in the two cited patents provide a degree of adjustability in the position of standing rigging as well as in the position of the outrigger floats making possible many additional improvements in sailing performance, safety and comfort.

The present invention provides feedback means permitting compensating interactive adjustments in the relative positions of elements of standing rigging and outrigger float connection apparatus, such adjustments being activated by changing forces of wind and water on the floats and sails, to produce such additional benefits.

It is an object of the above cited patents to provide means for varying the positions of floats from their normal extended positions, laterally spaced from the center section to provide stability in normal sailing attitudes, to positions raised above the center section, i.e., beneath the center section when the vessel is fully capsized, thereby rendering the vessel unstable in a inverted or capsized condition, and also to positions lowered to the sides of or below the center section of the upright vessel, thereby reducing the beam for various purposes such as trailering or accommodating a narrower berth.

It is another object of the above cited patents to provide means for adjusting the floats to and maintaining them in various orientations with respect to the center section at all heights between the fully raise and the fully lowered positions, which means may be contained inboard and in-place as permanent components of the structure and rigging, require no equipment to be attached or detached from the floats or arms to effect the adjustments and require no releasable restraints and a minimum of fixed limits on the rotation around joints within the float arms. Applications dependent on float adjustability, in addition to those mentioned for reducing the beam of the vessel with the floats in their extreme positions, include alterations in float height, distance from the center section and attitude relative to the center section for fine adjustments to the vessel's performance in different operational circumstances and for more radical changes in the vessel's performance characteristics. Such changes include lifting the main hull of a trimaran nearly clear of the water to gain any performance advantages of a catamaran and rotating the floats to bring planing or hydrofoil surfaces into operational positions.

It is a further object of the cited patents to make elements of the standing rigging adjustable such that the position of a mast may be varied from fully vertical to fully horizontal (in either the fore or aft directions) and such that adjustments of the mast can be carried out in a variety of ways, independently of or in conjunction with adjustments of the floats. Beside independent lowering of the mast for stowage and re-raising of the mast from the stowed position, the applications include: "lowering" the mast as the floats are "raised" in a capsize recovery for the purpose of pivoting shrouds out of the way of the floats; "lowering" the mast to the deck in a capsize recovery for the purpose of utilizing shrouds to life the floats, with motive force possibly being supplied by masthead flotation; causing the mast to be re-raised during capsize recovery by the re-lowering of the floats and leaving the mast stowed on the deck as floats are re-lowered during capsize recovery, with "raising" and "lowering" referred to the vessel in its upright position. It is a further object of the above cited patents to bring control of rigging or other equipment for adjustment of float and mast position to a central location where this control can be readily and selectably exercised by the crew for various operations while underway or during capsize.

It should be noted that in all of the following description, terms such as "up" and "down" or "raising" and "lowering" will be assumed to be defined in terms of the upright vessel, unless otherwise noted, even when it is being considered to be upside down in the water.

The preferred embodiments of the inventions disclosed in the cited patents include float arm assemblies, each pivotally connecting a float and the center section and each comprising a pair of arms, each arm comprising pivotally connected arm segments. These embodiments also include pairs of adjustable-length rigging lines connected between the pairs of arms in each float arm assembly and the center section and led to a central location for control by the crew of the relative positions of all float arms segments. They further include adjustable-length rigging lines connected between a mast pivotally connected to the center section and the center section and optional adjustable rigging lines connected between this mast and each of the floats.

These two patents do not fully describe how seemingly independent rotations at a multiplicity of pivot connections within float arm assemblies connecting the floats to the center section in the preferred embodiments of the basic invention can be simultaneously controlled with no more than two adjustable means in each float arm assembly to move the floats between desired positions and to maintain them at desired spacing from and orientation to the center section in each of these positions while the floats are being acted upon by variable and fluctuating external forces.

It is an object of the present invention to provide an arrangement of dual rigging lines connected between arm segments in each float arm assembly whereby: the float arm segments may be manipulated into desired orientations relative to one another, the resulting configuration of float arm assemblies will maintain the floats at desired positions relative to the center section in opposition to expected external forces on the floats and controllably small deviations from the desired positions will occur in response to expected fluctuations in such forces. The present invention provides control over the orientation of arm segments within float arm assemblies with a method and a concept not described and not anticipated in the two prior patents of this inventor.

It is a further object of the present invention to provide control means interconnecting the adjustable rigging from the separate float arm assemblies, such control means including manual means permitting common and equal as well as separate and independent movement of the outrigger floats between desired positions, the control means further including resilient reactive means connected between any of the adjustable rigging lines and any other rigging lines, the center section, the floats or the float arms, the resilient means keeping rigging lines under tension and operating reactively and independently of the manual means to permit adjustment within any one float arm assembly to sudden and variable external forces and to permit compensating adjustment within other float arm assemblies for purposes of maintaining the floats at desired positions relative to an irregular sea surface while minimizing changes in motion (or orientation) of the vessel's center section.

It is a further object of the present invention to provide a mast pivotally connected to the center section and permitting rotation of the mast toward either side of the center section in addition to rotation toward the fore or aft end of the center section and also to provide adjustable length control means between the mast and structural components of the vessel, such control means including manual means for controlling the rotation of the mast relative to the center section and further including resilient means within the adjustable length control means and interconnected with the float arm rigging control means or connected to float arm segments to permit interactive and compensating adjustments within float arm assemblies in reaction to rotation of the mast caused by sudden changes in the force of the wind on the sails, the purpose of the adjustments in float position being to minimize the effect of these flutuating forces on the motion of the vessel's center section or of the mast.

SUMMARY OF THE INVENTION

According to the present invention, there is provided a multihull vessel comprising a center section, which may be a cabin, platform or other superstructure with or without an attached center hull; a pair of floats oppositely spaced from the center section; a plurality of float arms connecting the floats to the center section and consisting of segments arranged in fore and aft float arm assemblies for each float and pivotally connected at their ends to the center section, to the floats or to other float arm segments; rigging lines connected between locations on or within float arm assemblies, the floats or the center section and led via pulleys or other guides within the float arm assemblies and the center section to means for controlling this rigging from a central location; at least one mast, normally connected pivotally to the center section; elements of standing rigging effectively adjustable in length, with the termination of this rigging or, optionally, of additional rigging, attached to the standing rigging or to pulleys riding on the standing rigging, being led to means for controlling this rigging from a central location within the center section and finally, controls in a central location for adjusting independently or simultaneously, in various selectable combinations, the length of rigging lines to vary the positions of either or both floats and the mast by any desired amount from fully raised positions to fully lowered positions.

A particular embodiment of the invention is a sailing trimaran (having a center hull) with double arm float arm assemblies jointed twice in the upper arms and pivotally connected at either end and jointed once in the lower arms and pivotally connected at the inboard ends. A mast is pivotably to the center section at a joint near the deck for rotation in both fore and aft directions as well as sideways. This embodiment will now be described, by way of an example, along with various alternative or optional features and extensions of the basic structure, with reference to the accompanying drawings.

DESCRIPTION OF THE PREFERRED EMBODIMENTS

Figure 1:
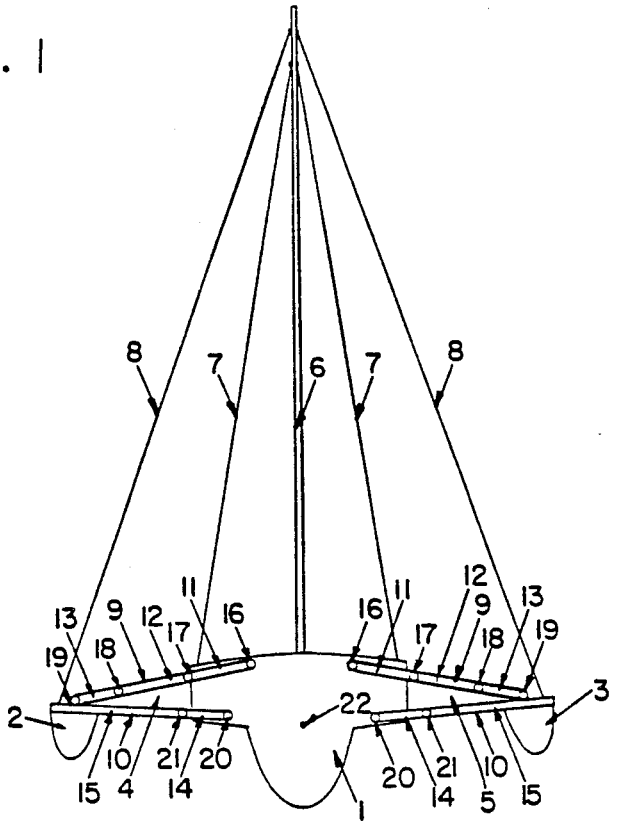
FIG. 1 is a cross-sectional view of a trimaran according to the invention at the section containing either the fore or aft float arm assemblies with the floats in their normal extended positions'.

The embodiments of the invention illustrated and described below all relate to but are not limited to sailing trimarans and FIG. 1 shows in cross-sectional outline a trimaran according to the invention with floats extended in normal sailing positions. The vessel comprises a center section or center hull 1 to which floats 2 and 3 are attached by float arm assemblies 4 and 5, a mast 6, and center section shrouds 7 between the mast and the center section and float shrouds 8 between the mast and the floats. The mast 6 and shrouds 7 and 8 may be broadly described as comprising part of a standing rigging which may also include conventional stays, etc. The upper float arms 9 and the lower float arms 10 consist of float arm segments 11, 12 and 13 for the upper arms 9 and of float arm segments 14 and 15 for the lower arms 10, respectively. Segments 11, 12 and 13 of the upper arms 9 are pivotally connected to the center hull 1, internally in two joints and at the floats 2 and 3 at pivots 16, 17, 18 and 19. Segments 14 and 15 of the lower arms 10 are pivotally connected to the center hull 1 and to each other at pivots 20 and 21 and fixedly at floats 2 and 3. All pivots 16, 17, 18, 19, 20 and 21 are oriented with axes substantially horizontal in a fore and aft direction. The segments and pivots are recited in order of increasing distance form the vessel's longitudinal axis through the center of gravity 22 and may be referred to unambiguously with such names as upper float arm middle arm segment 12 and upper arm inboard internal pivot 17, for example.

The float arm geometry illustrated in FIG. 1 is one embodiment or configuration of outriggers which has the capability of being used both to raise and to lower the floats through a range of desired heights and lateral distances from the center hull. In the laterally extended position for this double arm configuration both the upper arms 9 and the lower arms 10 are understood to be substantially straight.

As noted earlier, in all of the following description, terms imply direction relative to the vertical such as "up" and "down" or "raising" and "lowering" will be assumed to be defined in terms of the upright vessel, unless otherwise noted, even when reference is being made to a vessel upside down in the water.

Figure 2:
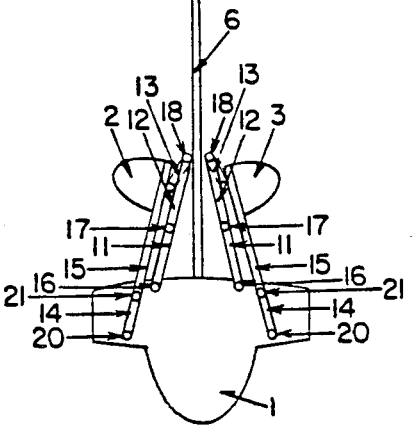
FIG. 2 is a cross-sectional view similar to FIG. 1 but with the floats raised upwardly and inwardly over the deck.

FIG. 2 illustrates in cross-sectional outline the relative positions of the float arm segments 11, 12, 13, 14 and 15 when the floats 2 and 3 have been pivotally raised near to their extreme positions over the middle of the center hull 1 against the mast 6. The only internal float arm pivots required for raising floats 2 and 3 in this manner are the upper arm outboard internal pivots 18. The shrouds 7 and 8 have been left out of this illustration.

Figure 3:
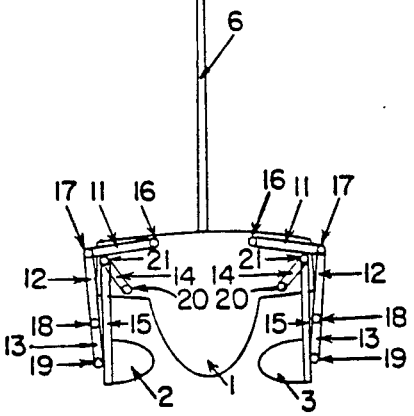
FIG. 3 is a cross-sectional view similar to FIG. 1 but with the floats lowered under the deck superstructure and inwardly to the sides of the center hull.

FIG. 3 illustrates in cross-sectional outline the relative positions of float arm segments 11, 12, 13, 14 and 15 when the floats 2 and 3 have been pivotally lowered toward the sides of the center hull 1 with the outboard float arm segments 12, 13 and 15 in substantially vertical orientation. Upper arm outboard float arm pivots 18 are not required for lowering the floats 2 and 3 in this manner. The shrouds 7 and 8 are not shown in this illustration.

Figure 4:
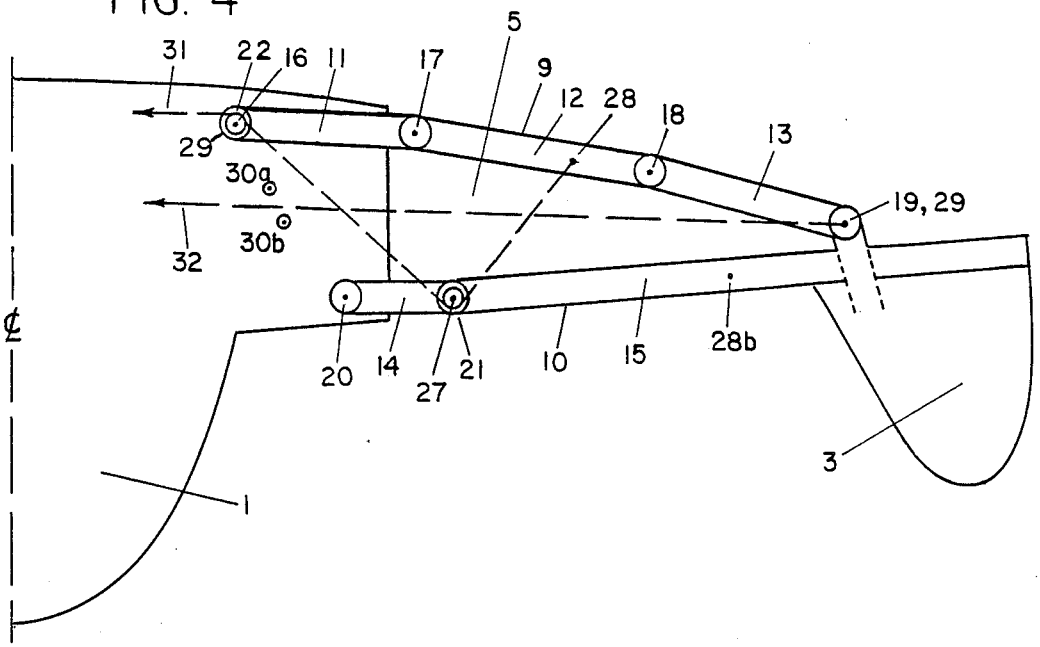
FIG. 4 is a cross-sectional view of one float arm assembly and the simplest feasible arrangement of internal rigging for controlling the positions of the floats.

FIG. 4 is a cross-sectional view of one float arm assembly 4 — either the fore or aft assembly — illustrating the simplest feasible configuration of rigging which could be employed with the float arm geometry shown in FIG. 1 to maintain the height of the float 3 at any position between the extremes represented in FIG. 2 and FIG. 3, with no restriction on the rotation of float arm segments around internal pivots 18, 19 and 21 other than that placed by this rigging. Two types of float arm control rigging lines, float-lowering rigging line 31 and float-raising rigging line 32, are used, respectively, to lower the float and to raise it with respect to the upright center section. Both types of rigging lines originate at fixed points within the float arm assembly 5, span the space between the float arms 9 and 10 in one or more places and are led through pulleys or around shafts or sleeves into the center section. The lines 31, 32 can be tensioned by conventional hand winches as depicted at 55 in FIG. 9 for example.

In the illustrated embodiment, the floating-lowering rigging 31 originates at point of intersection 28 in the middle upper arm segment 12 between internal pivots 17 and 18, is led around a tension redirecting pulley or sleeve 27 concentric with the lower arm internal pivot 21 and thence around a tension redirecting pulley or sleeve 22 concentric with the inboard upper arm end pivot 16 and is brought to suitable means for controlling its length. The principle function of the float-lowering rigging is, when shortened, to collapse the space between the arms, specifically the space between the middle upper arm segment 12 and the lower arm internal pivot 21, to draw this pivot toward the inboard upper arm pivot 16 and, when held at a given length under tension, to resist buckling outward of all three internal arm pivots 17, 18 and 21.

In the illustrated embodiment, the float-raising rigging 32 originates at point of connection 29 coincident with outboard upper arm end pivot 19, though it could be connected at any point fixedly attached to the outer lower arm segment 15, spans the space within the vertical confines of the float arm assembly laterally between its outboard termination and the center section (i.e., the rigging 32 is disposed below the intermediate pivots 17, 18 and above the intermediate pivot 21) and is brought through pulleys or shafts 30*a* and 30*b* in the center section to suitable means for controlling its length. Thus, the rigging line 32 extends entirely within a space disposed between the axes of rotation of the pivots 17, 18, 21 while the float arm assembly is in the positions depicted in FIGS. 4 and 6. The rigging line 32 extends in a substantially straight path from the center section to its location adjacent the float, when the float arm assembly is in the position depicted in FIG. 4. The principal function of the float-raising rigging is, when shortened, to draw the outward ends of the float arms toward the center section, to increase the outward buckling of the float arms at the internal arm pivots, especially the outboard upper arm internal pivot 18, to create an upward rotational moment of the lower arm around inboard pivot 20 and, when held at a given length under tension, to resist the inward buckling of the three outwardly buckled internal pivots 17, 18 and 21. It will be appreciated that the orientation of the rigging 32 at the pivot 19 produces a lifting force inherently having a larger component in the horizontal direction than in the vertical direction. If the float control rigging lines 31 and 32 are held at fixed lengths, rotation of float arm segments will occur around each pivot connection and the rigging lines will be put under tension until, at equilibrium, the moments of all internal forces around the float arm pivots caused by tension on rigging lines running between arm segments and the moments around the float arm pivots caused by the external forces on the float will sum to zero separately for each pivot. If the arm segments are in collinear orientation in each arm and if the external force is directed through the outboard point of connection of the arms at pivot 19, one arm will be under compression and the other will be under tension, these forces being directed through the arm pivots, and zero tension forces will be required on the rigging lines to maintain this configuration of the float arm assembly.

The float arm assembly shown in FIG. 4, with arm segments of each arm essentially collinear, with the lower arm under tension, with the upper arm under compression and with no tension on either float control rigging line, would be in an unstable equilibrium. This equilibrium could be maintained, without any other type of restraint on the rotation of arm segments around their respective internal joints, only as long a sufficient upward force is maintained on the float by the buoyant effect of the water. A similar condition of unstable equilibrium would result from the weight of the float when lifted out of the water, with the upper arms under tension and the lower arms under compression. In a transient state, with the resultant force on the outer pivot 19 of the upper arm 9 connecting it to the lower arm 10 dominated neither by the buoyant force on a float nor by the weight of the float and with no restraint on the motion of arm segments around internal pivots 17, 18 and 21 other than that imposed by control rigging lines 31 and 32 in such a configuration, transient forces on the arms could disturb this equilibrium of collinear arm segments. In such a transition state, the weight of the upper arm could be sufficient to cause a downward buckling of upper arm internal pivots 17, 18. After such an occurrence of arm buckling, the float arm assembly would lose its structural integrity against further buckling and could not transmit the buoyant force of the float to the center section of the vessel for the purpose of resisting heeling. An upward collapse of such a float arm assembly, in such an unrestrained configuration, could also occur with outward buckling of one of the upper arm internal joints 17 or 18 accompanied by an inward buckling of the other. If an inward buckling of the lower arm occurred simultaneously at internal pivot 21, there would be no way to prevent further collapse (effective shortening) of the upper arm with control line 31.

It can be demonstrated, however, with upper and lower arms 9 and 10 buckled slightly outward from their collinear positions around all three internal arm pivots 17, 18 and 21 and with both rigging lines held under tension at constant length, as shown in FIG. 4, that the arms would remain buckled outward at these joints for combined external forces less than a maximum allowable force, that only slight rotations of the arm segments around the internal pivots would occur in response to substantial changes of external force on the float, and that relatively small amounts of tension will be required on the float control rigging lines to maintain the float arm segments in their resulting orientations with respect to each other after such an adjustment. For a given float arm geometry, with arm segment lengths determined by the requirements of the extreme positions of FIGS. 2 and 3, the principal remaining variable to be determined in order to minimize unwanted rotation of arm segments away from collinear orientations at a given internal pivot is the precise location of the outboard termination 28 of float-lowering rigging line 31. The only major problem encountered with the configuration of FIG. 4 is that, once the float arms are allowed to buckle inwardly past a collinear orientation around any of the internal arm pivots 17, 18 or 21, there is nothing to interfere with further buckling around the joint in question until that joint comes to rest against rigging line 32 or the opposite arm, and other means would be required to restore the arm to a collinear orientation.

In practice, one would not construct float arm assemblies such as that illustrated in FIG. 4 with such a simple arrangement of control rigging lines 31 and 32 and with no restrictions or restraints on the inward buckling of the arms at internal pivots 17, 18 and 21. Such restrictions could be provided by a variety of means, including: (1) constructing pivots 17, 18 and 21 as hinges permitting rotation of arm segments around the pivots in only one direction with respect to each other, i.e., away from a collinear orientation; (2) providing other structural elements on the arm segments to limit their rotation around the internal pivots; (3) providing permanent or removable structural elements within the center section to limit the rotation of inner arm segments 11 and 14 and on the float or outer lower arm segment 15 to limit the rotation of outer upper arm segment 13; (4) providing resilient means within or on the arms extending across pivots 17, 18 and 21 to resist the rotation of arm segments around these joints and to restore them to a collinear orientation and (5) connecting a shroud 8 or 8*a* between the mast and one of the upper arm segments 11, 12 or 13. Nevertheless, given such physical restraints on the inward buckling of the float arms, the apparatus of FIG. 4 provides simple, direct control of the float arm assembly for desired changes in float height.

Figure 5:
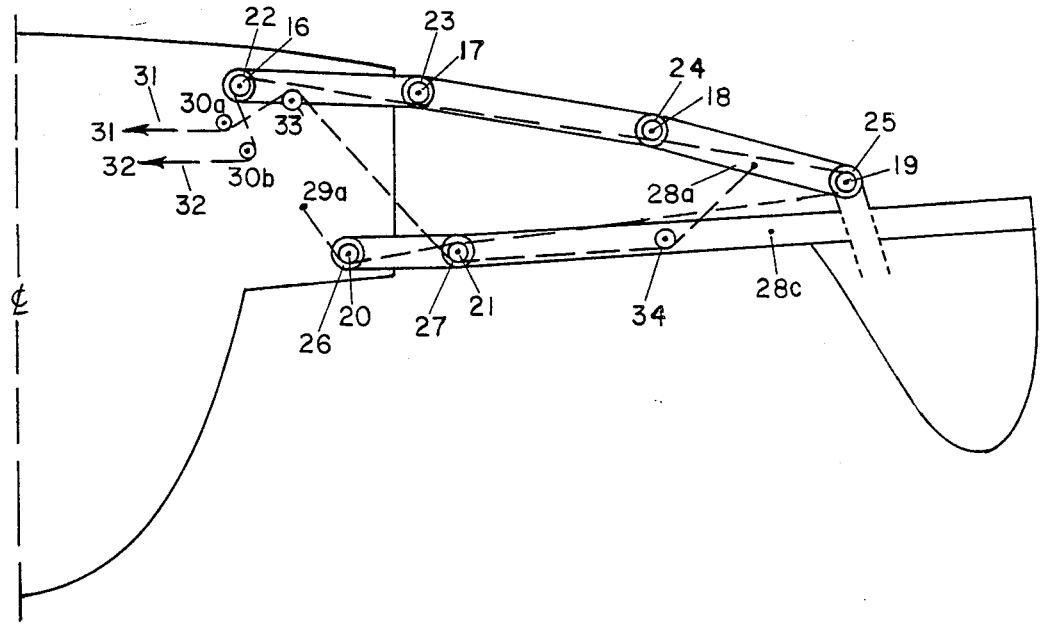
FIG. 5 is a cross-sectional view of one float arm assembly and another embodiment of the internal rigging for controlling the positions of the float with an increased amount of control over the orientation of individual arm segments.

FIG. 5 is a cross-sectional view of a float arm assembly with the same geometry as in FIG. 4, wherein the above-described problem of unwanted buckling of float arms has been solved without introducing additional control means and without restriction on the rotation of the arms at internal pivots and wherein further reduction of undesired rotation around the internal joints has been accomplished with the introduction of two tension redirecting pulleys or shafts within the float arm assembly. A spreading force on all three of internal pivots 17, 18 and 21, opposing inward buckling of the arms at these joints is produced by leading the float-raising rigging line 32 along and within the length of both float arms, this rigging line passing on the inward side of either arm (i.e., above the intermediate pivot 21 and below the intermediate pivots 17, 18 over pulleys or sleeves 27, 24 and 23 concentric with the internal pivots 21, 18 and 17 and passing around pulleys or sleeves 26, 25 and 22 concentric with the pivots 20, 19 and 16 at the ends of the arms. Starting at fixed point 29*a* in the center section inboard of lower arm inboard end pivot 20, the rigging line 32 is passed outward along the lower arm to upper arm outboard end pivot 19, back along the upper arm to upper arm inboard pivot 16 and thence around suitable pulleys or shafts in the center section to means for controlling its length. It will be appreciated that the orientation of the line 32 at the pivot 19 as depicted in FIG. 5 will produce a lifting force which inherently has a larger component in the horizontal direction than in the vertical direction. Improved control over the relative orientation of the upper arm segments is provided by introducing auxiliary tension redirecting pulleys or shafts 33 and 34 in the inner upper arm segment 11 and outer lower arm segment 15, respectively, and by leading the float-lowering rigging line 31 from a fixed origination point 28*a* in the outer upper arm segment 13 around tension directing pulley 34, pulley or sleeve 27 and tension redirecting pulley 33, as shown, to means in the center section for controlling its length.

It is noted that the outboard terminations 28 and 28*a* of the float control rigging 31 in FIG. 4 and FIG. 5, respectively, could be replaced by a tension redirecting pulley or shaft and the rigging line could be led to a new termination 28*b* or 28*c* if this proved to provide an advantage.

Figure 6:
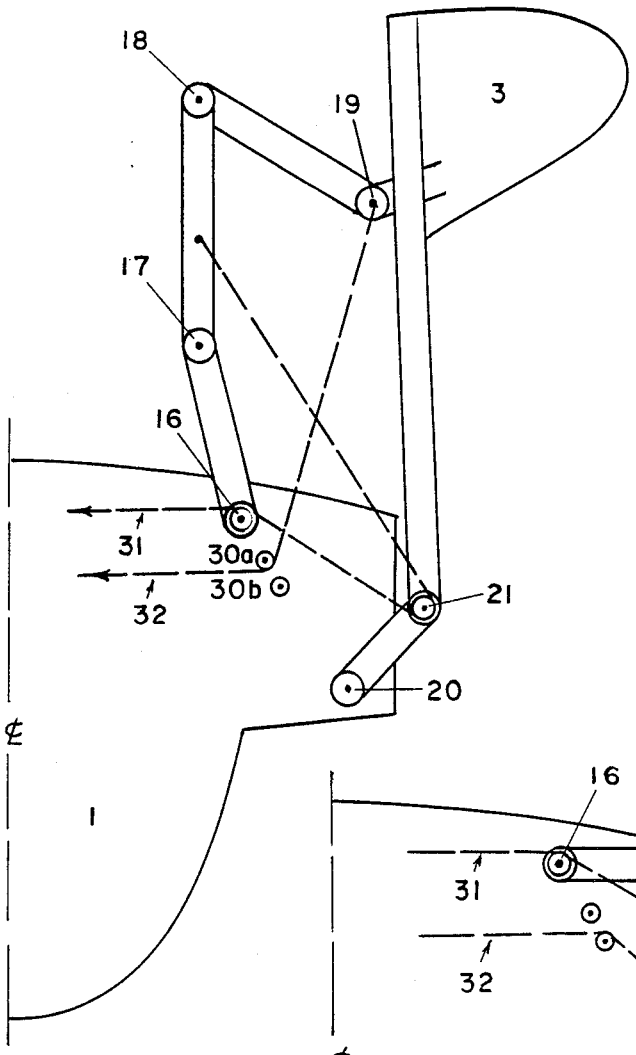
FIG. 6 is a cross-sectional view of one float arm assembly and internal rigging with the float in a raised position.

FIG. 6 is a cross-sectional view of float arm assembly 5 with the same geometry and control rigging arrangement as is FIG. 4, wherein the float 3 has been moved upwardly and inwardly from its laterally extended position of FIG. 4 to a position above the center section. This is accomplished with the control rigging arrangement of either FIG. 4 or FIG. 5 by shortening float-raising rigging line 32 and while simultaneously or subsequently relaxing float-lowering rigging line 31. A reversal of this procedure, i.e., shortening line 31 with simultaneous or subsequent relaxing of line 32, will return the float to its laterally extended position with substantially collinear arms.

Figure 7:
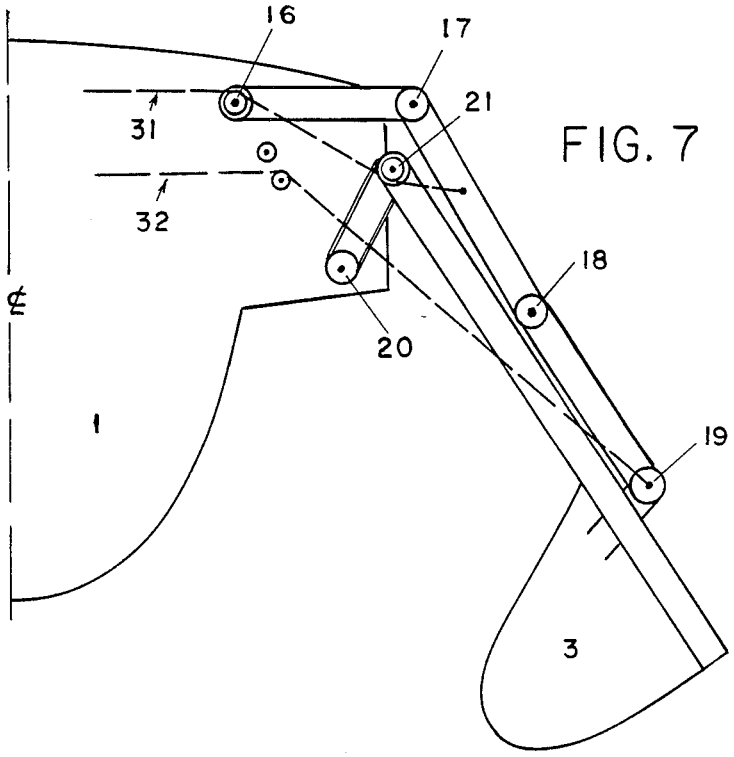
FIG. 7 is a cross-sectional view of one float arm assembly and internal rigging with the float in a lowered position.

FIG. 7 is a cross-sectional view of float arm assembly 5 with the same geometry and control rigging arrangement as in FIG. 4, wherein the float 3 has been moved downwardly and inwardly from its laterally extended position of FIG. 4. This is accomplished with the control rigging arrangement of either FIG. 4 or FIG. 5 by shortening float-lowering rigging line 31 and simultaneously or subsequently relaxing float-raising rigging line 32 enough to permit inward buckling of lower arm 10 at its internal pivot 21. A reversal of this procedure, i.e., shortening line 32 while simultaneously or subsequently relaxing line 31, will return the float to its laterally extended position with arms substantially collinear and buckled slightly outward at internal pivots 17, 18 and 21 only if a rigging arrangement such as that illustrated in FIG. 5 is used to keep the rigging lines from moving past inwardly buckled lower arm internal pivot 21 outside the confines of the space between the float arms or some other means is provided to keep line 32 from getting past pivot 21.

In both float control rigging configurations illustrated in FIGS. 4 and 5, the two types of rigging under tension are each attempting to collapse the space between the upper and lower arms in one of two generally perpendicular directions, one across the vertical confines of the float arm assembly and the other across the longitudinal confines of the float arm assembly, while opposing the collapse of this space in the other dimension. The discovery that these two opposing effects can be associated each with one of two control means and can be utilized to maintain the shape of the float arm assemblies with the internal orientations of arm segments required to maintain the float at a given position relative to the center section is an important and original improvement to the control configurations described in the prior art patents. In the two cited patents, rigging lines or other means of control are used to apply force directly at locations in the arm segments with the intention of creating around each arm pivot rotational moments which could be balanced by selecting the locations appropriately. Using rigging lines in manner set forth in the two earlier discussed Thurston patents as the means of control, a multiplicity of tension redirecting pulleys or shafts would be required, and unless both rigging lines were led around each internal pivot, passing on opposite sides of each pivot, an unopposed collapsing force would exist, causing unwanted inward buckling of the float arm assemblies at the neglected pivot or pivots and unwanted displacement of the float from a desired position until the collapsing force is opposed by structural limits.

In the herein described embodiment of the invention, two float arm control means are employed to control the shape of each multisegmented float arm assembly to move and maintain the floats through a range of positions. Since two float arm assemblies are required for fore and aft pivoted attachment of two outrigger floats to the center section, four float arm control rigging lines of each of the two types may be brought into the center section to suitable means for adjusting their length. It is desirable to provide crew operable control means, referred to as manual control means, even if such means include additional power means, for adjusting all four lines of each type by the same amount. It is also desirable to provide manual control means for adjusting the two lines of each type associated with the leeward float and those from the windward float by differing amounts so that the floats can be positioned independently and asymmetrically with respect to the center section to compensate for the heel of the vessel or the changing inclination of the sea surface on large waves and to maintain the windward float at any desired height relative to the sea surface. It may also be desirable to provide manual means for readjusting the fore and aft lines of each type separately for purposes of adjusting the fore and aft trim of the vessel, thereby causing an improvement of the vessel's performance characteristics under different sailing conditions.

It is further desirable to provide resilient means for reactively adjusting the length of float control lines in response to sudden and impulsive changes in the buoyant forces or wave action on part of or on the full length of either float. Such changes in the buoyant forces acting on the floats may include those caused by sudden changes in pitch or heel of the vessel due to impulsive action of the wind on the sailplan. The resilient means may comprise the rigging itself in the form of stretchable lines, may comprise spring means serially connected within the rigging lines, or may comprise spring loaded take-up mechanisms contained in channels within the center section and operating on single control lines, one end being attached to the center section, or operating between pairs of lines of the same or of different types. It is noted that there is a natural resiliency within each float arm assembly (even without any change in the length of the control lines) caused by the rotation of arm segments around internal pivots to restore the balance upset by changing external forces on the floats.

In the herein described embodiment of the invention, it will be shown that control means of both the crew operated (i.e., manual) type and the reactive (i.e., resilient) type, whether acting on both floats equally, acting on either float independently, or acting on any float arm assembly separately, can all be activated independently and or concurrently.

Figure 8:
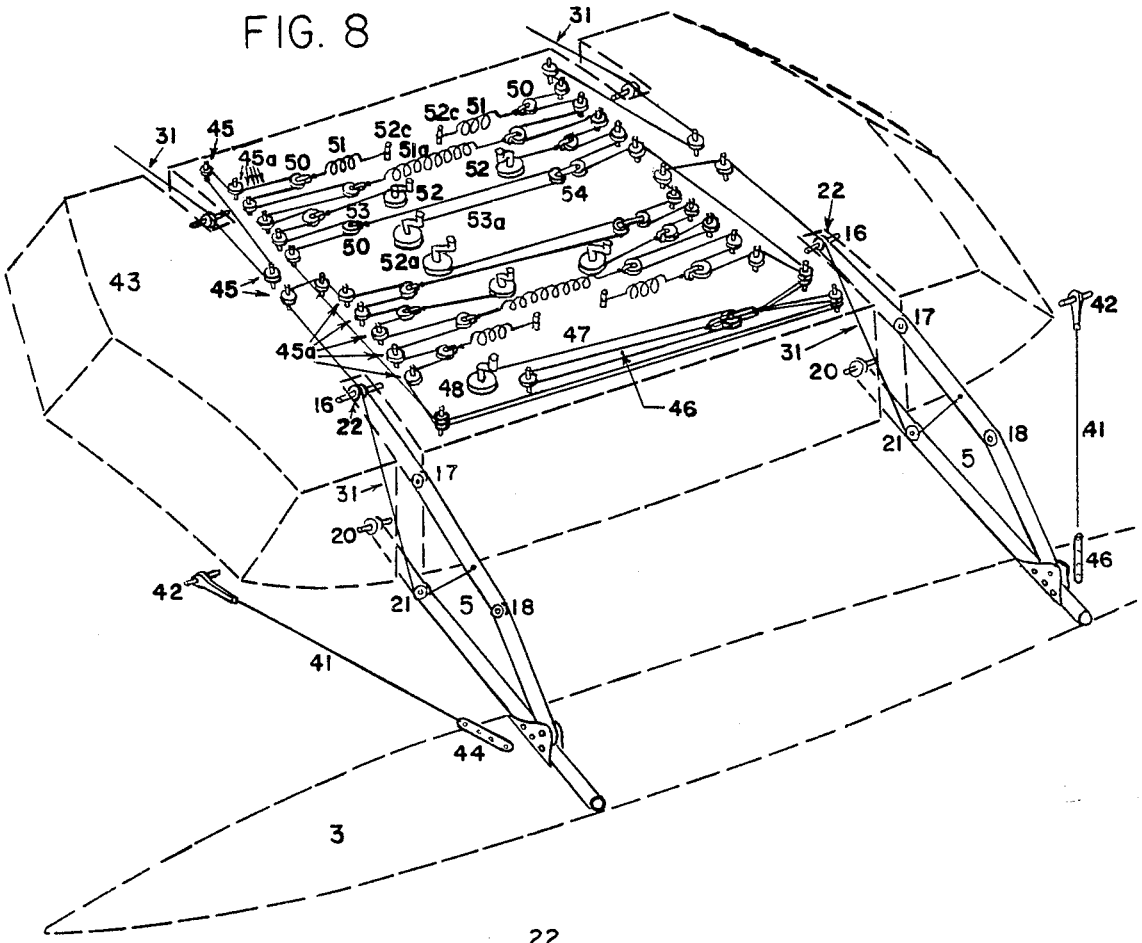
FIG. 8 is a perspective view of the pair of port float arm assemblies, an embodiment of one type of float position adjusting rigging with inboard means for controlling this rigging collectively for each float arm assembly, and diagonal braces or stays between the port side of the superstructure of the center section and the deck of the port float, the outline of the center section and the float deck being shown in dotted outline.

FIG. 8 is a perspective, somewhat schematic view of the pair of port float arm assemblies 5, illustrating the embodiment of FIG. 4 of the float-lowering rigging 31 for these arms; one particular embodiment of a system for adjustment and control of all four float-lowering rigging lines 31; diagonal stays 41 between the float 3 and the center section 1; the outline of the superstructure 43 of the center section and the outline of the deck of the float. This embodiment of a method for bringing control of float-lowering rigging 31 to a central location shows an example of every control mode already mentioned, whether common or separate, interactive or independent, crew operated or reactive, for adjustment of one or more of these lines. The float-raising rigging lines 32 could be handled with a similar arrangement of control means. It is not anticipated that every such mode for controlling either type of float arm rigging lines would be employed nor that they would be employed in a physical arrangement similar to that shown, the intended purpose of the diagram being to show that any of these modes can be simultaneously implemented.

In FIG. 8 the control lines 31 are all brought from upper arm inboard pivots 16 via fixedly located tension redirecting pulleys 45 and **45*a* past the take-up rigging for various secondary adjustment devices to block and tackle 46 with a common fall 47, all under the deck of superstructure 43, to a single winch 48, which could be in the cockpit or reachable from the cockpit, for common adjustment of all four lines by equal amounts. The secondary adjustment devices each include floating pulleys 50 riding on the control lines 31, between pairs of tension redirecting pulleys 45*a*, fixedly located on opposite sides of lines 31 from the pulleys 50, the floating pulleys 50 being attached either directly to springs or other resilient devices 51 or 51*a* or to winches 52 or 52*a* or other manual control means via auxiliary rigging lines 53 or 53*a* or auxiliary block and tackle means 54, these latter devices all being located on the same side of lines 31 as the pulleys 45*a*. The resilient devices 51 may be attached fixedly at the other end to the super structure 43 for control of a single rigging line 31 while resilient devices 51*a* may be attached between floating pulleys 50 from a fore and aft pair of such rigging lines. Auxiliary manual control rigging lines 53 may be led directly to winches 52 for independent control of individual rigging lines, and manual control rigging lines 53*a* may be led directly or via further tension redirecting pulleys 54 to winches 52*a* for common control of a fore and aft pair of rigging lines 31**.

Further block and tackle means may be introduced to work with auxiliary manual control lines 53 or **53*a* to provide greater mechanical advantage. The block and tackle means 54, as shown, permit lines 31 from the fore and aft float arm assemblies to adjust by different amounts in response to different forces on the float, supplementing or substituting for the action of resilient means 51. It is noted that the function of resilient means connecting fore and aft rigging lines 31 may be largely redundant with that of resilient means operating on individual lines 31, but these two types of resilient means may have different amounts of spring stiffness and different spring lengths designed to react to different types or amounts of transient forces applied to the float arm assemblies. It is also noted that the functions of manually operated and resiliently reactive auxiliary control lines could be combined by replacing the fixed point of connection 52*c* of resilient devices 51 with winches (not shown) operable from the cockpit or by including resilient devices 51*a* within manually operated control lines 53*a***.

Means other than block and tackle and centrally located winches could be employed to control float arm rigging lines 31 and 32 from a central location. These could include electric-motor-driven winches anywhere inboard of the entry into the center section superstructure 43 of individual rigging lines 31 or 32 with appropriate electrical switches or controls at the central location or mechanical systems employing gears, shafts, chains and sprockets and cranks for operating such winches.

Figure 9:
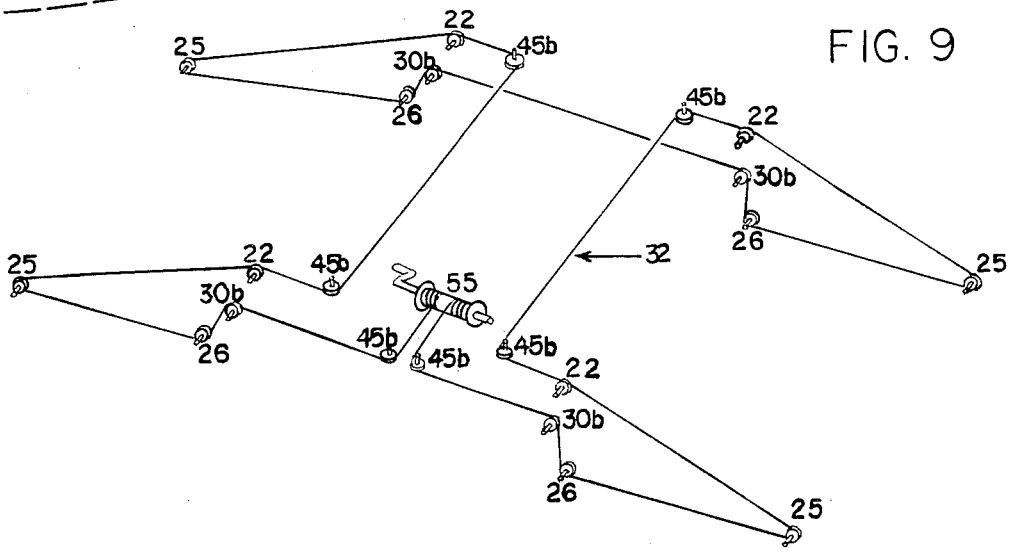
FIG. 9 is a schematic view of an embodiment of rigging for simultaneously controlling the positions of the float with a continuous connection of this rigging between all four float arm assemblies.

The pivot connection stays 41 shown in FIG. 8 are pivotally mounted at pivots 42 located on the center section including resiliency of float arm assemblies 4 and 5 superstructure 43 with longitudinal axes of pivots 52 on a common line with lower float arm inboard pivots 20 and are fixedly mounted with fasteners 44 at points on or near the deck of float 3. The pivot connection stays 41 are located in a substantially horizontal plane under tension when the float 3 is in its normal laterally extended position with the lower arms 10 in an essentially straight orientation. The pivot connection stays 41 remain under tension at an oblique angle to a vertical transverse plane as float height is changed without altering the angle between lower arm segments 14 and 15 at pivots 21 and will remain in an essentially common plane with lower arms 10 in such a circumstance to provide resistance to fore and aft bending of float arm assemblies 5. If all internal float arm joints 17, 18 and 21 are buckled at least slightly outwardly with respect to the space between upper and lower float arms and if rotation of any of the upper arm segments around one of the pivots 16, 17, 18 or 19 in each upper arm 9 is restricted by physical means, with float-lowering rigging lines 32 and pivot connection stays 41 all under tension and of fixed length, rigid float arm assemblies 5 can be maintained with no rotation of float arm segment around any pivots. Releasable or adjustable devices such as lever locking mechanisms or turn-buckles could be employed with pivot connection stays 41 to switch or adjust these stays between lengths at which the lower line 2 float arms 10 could pass through positions in which they are fully straight at joints 21 to positions at which they must remain bucked at joints 21. FIG. 9 is a schematic view of an alternate scheme for bringing float-raising rigging control lines 32, illustrated in the embodiment of FIG. 5, to a common means for controlling their length. This scheme could also be employed with float-lowering rigging-control lines 31 if the outboard terminations **28*a* of these lines are replaced with tension redirecting pulleys or shafts, permitting the lines to be led back into the center section and thence to other float arm assemblies. In this scheme, the rigging lines are led via tension redirecting pulleys 45*b* attached within the center section as one continuous line from float to float, either end of this line being led to a common winch 55 in the center section. This arrangement permits continuous interactive adjustment of all float arm assemblies to external forces on the float, the amount of adjustment differing between the port and starboard floats and along the length of a float. By permitting compensating opposing adjustments among the separate float arm assemblies, especially between fore and aft pairs and between starboard and port pairs of these assemblies, to maintain a balance of forces on each internal pivot 17, 18 and 21** in all four float arm assemblies simultaneously, such an arrangement provides the effect and the benefits of resilient means, without including such means explicitly in the apparatus, by allowing floats to compensate for localized forces, thus minimizing the effect of these forces on the center section. Similarly such an arrangement can minimize the effect on the center section and on a mast caused by different steady forces on the separate float most subject to a buoyant force to adjust upwardly and its counterpart less subject to that force to adjust downwardly. This result will also depend on the manner in which mast shrouds are attached to the vessel.

Since, in such an arrangement of the type described in FIG. 9, all impulsive forces are transmitted via rigging lines to movable structural elements which are only pivotally connected to the center section, a large part of the impulsive power of wind and waves will be absorbed into compensating motions of the floats rather than into structural strain at fixed connections between float arms and the center section or the floats, as is the case with conventional multihulls. The disadvantage of such an interconnected arrangement of float control lines is that it removes the possibility of simultaneous separate control of the rigging lines from each float or float arm assembly and also that it makes other resilient adjustment means within the float arm assembly at least partially superfluous.

Other embodiments of the invention having float pivot connection means for movement of floats between positions laterally extended from the center section and positions raised above the center section as well as positions lowered beneath the center section and positions intermediate these positions, may use inboard control means of the types described in reference to FIG. 8 or FIG. 9 to adjust floats to and maintain them at any of these positions even when the pivot connection means are not of the multisegmented, double float arm configuration of the herein described preferred embodiment. Particular alternate embodiments of the invention have nonsegmented upper and lower arms having inner pivot connections of these arms slidingly connected on tracks to the center section or outer pivot connections of one arm slidingly connected on tracks to the other arm. Such an embodiment of the invention will now be described.

Figure 10:
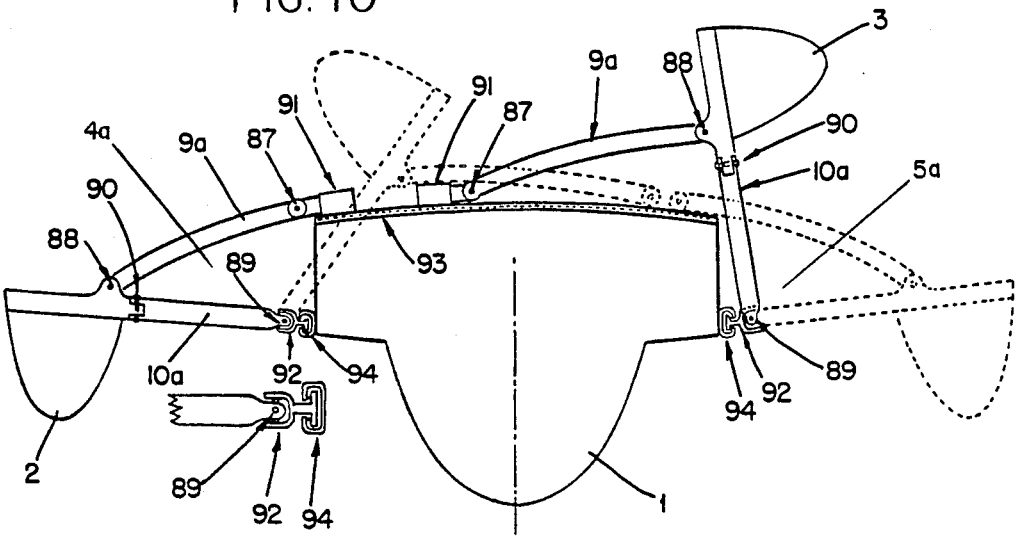
FIG. 10 is a cross-sectional view of a trimaran according to the invention with float arms pivotally and displaceably connected along tracks to the center section, illustrating the raising of the floats by movement of the pivot connections on the tracks.

FIG. 10 is a cross-sectional view of a tramaran according to the invention with float arm assemblies **4*a* and 5*a* comprising upper and lower arms 9*a* and 10*a*, pivotally connected at both inboard and outboard ends between center section 1 and floats 2 and 3, the inboard ends being slidingly movable on tracks 93 and 94 affixed to the center section 1, the movement of the upper arms 9*a* along tracks 93 acting to decrease the effective distance between floats 2 and 3 and the center section 1, thereby displacing floats 2 and 3 upwardly and inwardly to raised positions, and the movement of lower arms 10*a* along tracks 94 acting to decrease the effective distance between floats 2 and 3 and the center section, thereby displacing floats 2 and 3** downwardly and inwardly to lowered positions relatively to their laterally extended positions.

Figure 11:
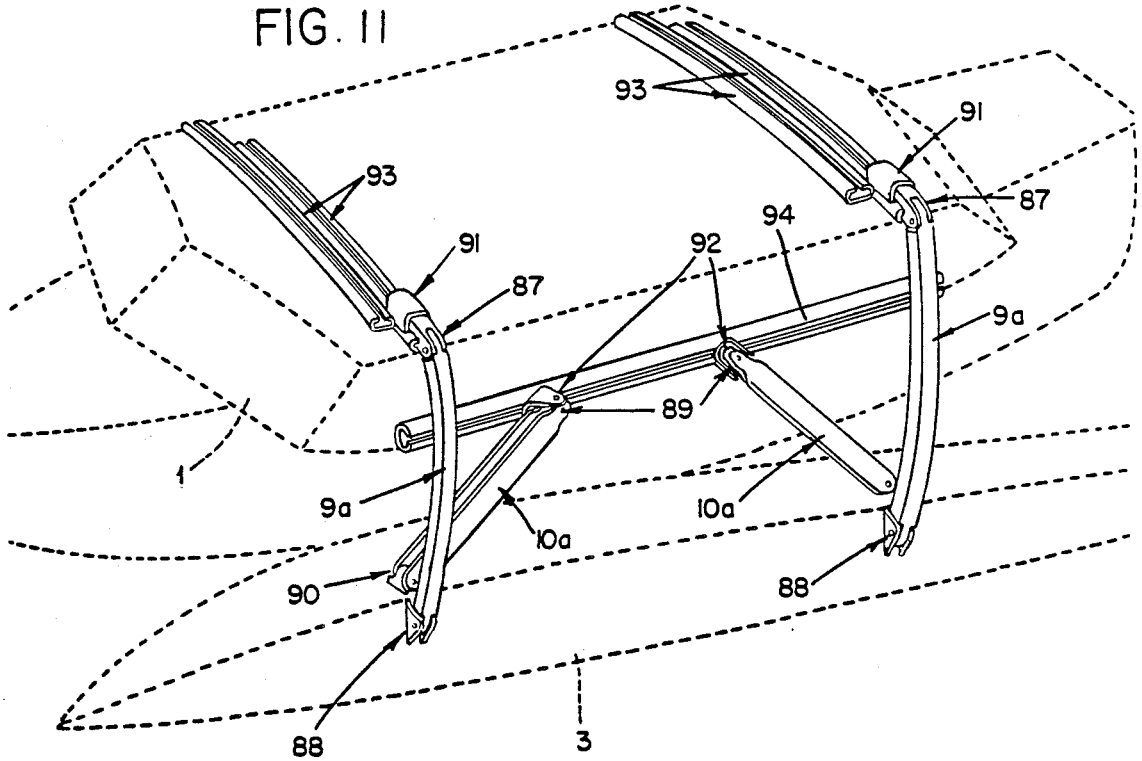
FIG. 11 is a cross-sectional view of the port float and part of the center section for the same embodiment of the invention shown in FIG. 10, here illustrating the float in its lowered position and the corresponding displacement of the float arms on the tracks.

FIG. 11 is a perspective view of this same embodiment of float pivot connection means showing the superstructure of center section 1 in outline, tracks 93 and 94 mounted thereon, upper and lower float arms **9*a* and 10 connected between sliding pivot means 91 and 92, respectively, and port float 3 with pivots 87 and 89, respectively, at their inboard ends and pivots 88 and 90**, respectively, at their outboard ends.

FIG. 10 shows port float 3 in a raised position, moved upwardly and inwardly from its laterally extended position. FIG. 11 shows port float 3 in a lowered position. Referring now to either FIG. 10 or FIG. 11, upper arms **9*a* are connected to the respective associated floats 2** and 3 at outboard pivots 88 and to sliding pivot connections 91 at inboard pivots 87, the sliding pivot connections 91 being movable in tracks 93 mounted substantially transversely atop the center section 1. The axes of upper arm pivots 87 and 88 are generally parallel to the longitudinal axis of the vessel. Lower arms 10*a* are connected to the respective associated floats 2 and 3 at outboard pivots 90 and to sliding pivot connections 92 at inboard pivots 89, the sliding pivot connections 92 being movable in tracks 94 mounted in a substantially longitudinal fore and aft direction on the sides of the center section 1. The axes of outboard lower arm pivots 92 are generally vertical when associated floats 2 and 3 are in their laterally extended positions. Pivots 89 each comprise a universal joint mechanism with one axis remaining essentially parallel to the longitudinal axis of the vessel when the associated float 2 or 3 is moved upwardly and inwardly above center section 1 and with a second axis changing from a substantially vertical orientation as sliding pivot connection 92 is moved along track 94 away from its initial position, wherein lower arm 10*a* is in a substantially transverse orientation relative to the vessel's longitudinal axis, toward a position wherein lower arm 10*a* has an oblique orientation in a generally fore and aft vertical plane relative to the vessel's longitudinal axis as the associated float 2 or 3 is moved downwardly and inwardly, the movement of pivot connection 92 being accompanied by rotation of the universal joint at pivot 89 around an axis perpendicular to track 94.

Referring to FIG. 11 it can be seen that upper arm tracks 93 are mounted side-by-side in pairs, one fore and one aft, slightly obliquely to a vertical transverse axis so that upper arms 9*a* can cross as floats 2 and 3 are raised. It can also be seen that float arm assemblies 5*a* are separated fore and aft at sufficient distances relative to the length of lower arms 10*a* that fore and aft lower arm sliding pivot connections 92 can share the same tracks 94 for each associated float 2 or 3.

In such an embodiment of a multihull vessel with upper and lower arms 9*a* and 10*a* slidingly movable in tracks to effectively decrease the separation of floats 2 and 3 from center section 1 for raising the floats relative to their laterally extended positions by such movement of upper arms 9*a* or for lowering of floats relative to their laterally extended positions by such movements of lower arms 10*a*, certain variations in the placement of tracks are possible. In particular, tracks 93 for upper arms 9*a* could be arranged in a fore and aft direction atop or aside the superstructure of center section 1 or could be located with fore and aft orientation on floats 2 and 3 outboard the pivot connections for lower arms 10*a*. In like fashion, tracks 94 for lower arms 10*a* could be moved to locations beneath the superstructure of the center section 1 or to locations on floats 2 and 3.

It will be noted that with any such embodiment of the invention employing sliding pivot connection means between center section 1 and floats 2 and 3 internal pivots in upper and lower float arms 9*a* and 10*a* would not be required to achieve the required raising and lowering of the floats. Without such internal pivots the need for rigging or other float height control rigging internal to float arm assemblies 4*a* and 5*a* would not be required either, and suitable control means can be attached directly to the sliding pivot connections 91 and 92 to effect such float movement.

Figure 12:
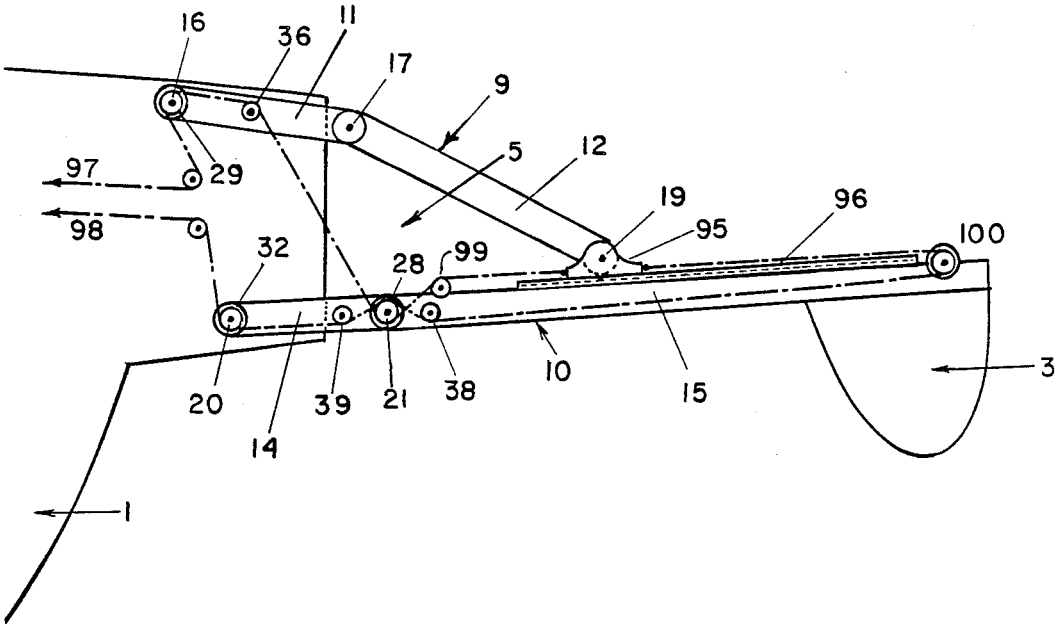
FIG. 12 is a cross-sectional view of one float arm assembly with a pivot at the outer end of the upper arm displaceably connected to the lower arm along a track fixed thereupon.

FIG. 12 is a cross-sectional view of a trimaran according to the invention showing one float arm assembly 5 having upper and lower float arms 9 and 10 pivotally connected between the center section 1 and float 3, the upper arm means being pivotally connected at its outer end, pivot 19, to sliding pivot means 95, pivot means 95 being slidingly affixed to a movable track 96, track 96 being mounted on lower arm 10.

Upper arms 9 and lower arms 10 are internally jointed at internal pivots 17 and 21, these pivots serving the same function as intermediate pivots 17 and 21 in FIGS. 2 and 3 for raising and lowering floats 2 and 3 relative to a laterally extended position. Comparing FIG. 12 with any of FIGS. 1 through 8, it can be seen that an outer internal pivot 18 in upper arm 9 has been eliminated in FIG. 12, the function of rotation of upper arm segments 12 and 13 around pivots 18 in FIGS. 1 through 8 to permit upward movement of float 3 being replaced by sliding displacement of sliding pivot means 95 in FIG. 12.

Internal pivots 17 and 21 are principally involved in lowering float 3 below its laterally extended position and are, in fact, not needed for raising float 3 above the laterally extended position. Float lowering rigging line 97 and float raising rigging line 98 are led, respectively, from the inboard side of sliding pivot means 95 via tension directing devices 99, 28, 36 and 29 and from the outboard side of sliding pivot means 95 via tension directing devices 100, 38, 28, 39 and 32 to suitable means in center section 1 for controlling their length and are shortened, respectively, to move pivot 19 toward center section 1, thereby raising float 3 above its laterally extended position, and to move pivot 19 away from center section 1, thereby lowering float 3 back to is laterally extended position. Further shortening of rigging line 97 after sliding pivot means 95 has reached its inboardmost limit on track 96 (accompanied by a small relaxation of rigging line 98) will act to displace lower arm internal pivot 21 upwardly, thereby decreasing the effective length of lower float arm 10 to lower float 3 below its laterally extended position.

Except for the fact that only one float arm in each float arm assembly 5 is directly connected to float 3 and that engineering design of sliding pivot means 95 may present greater problems in several areas than the design of an internal pivot 18, the embodiment of a pivotally connected float arm assembly shown in FIG. 12 can have all the advantages of the embodiments FIGS. 4 or 5 which pivotably mounts a floatcarrying leg 15A. The leg is pivotably mounted at 29*h* to the outer segment of the upper arm assembly against impact forces on floats 2 and 3, with the placement of tension directing devices 36, 38, 39 and 99 calculated to achieve the required balance of forces at each internal pivot 17 and 21 for each desired orientation of float arm segments 11, 12, 14 and 15 presenting perhaps less of a problem than the placement of auxiliary tension directing pulleys in the embodiment of FIG. 4 or FIG. 5.

Control rigging lines of the types of float-lowering rigging 31 and float-raising rigging 32 may be used to move the sliding pivot connections 95 in their tracks 96 and to control internal pivots 17 and 21 simultaneously. Such rigging lines may be controlled in a manner described for FIG. 8 for simultaneous and interactive and for crew-operated as well as reactive adjustment of float position.

Figure 13:
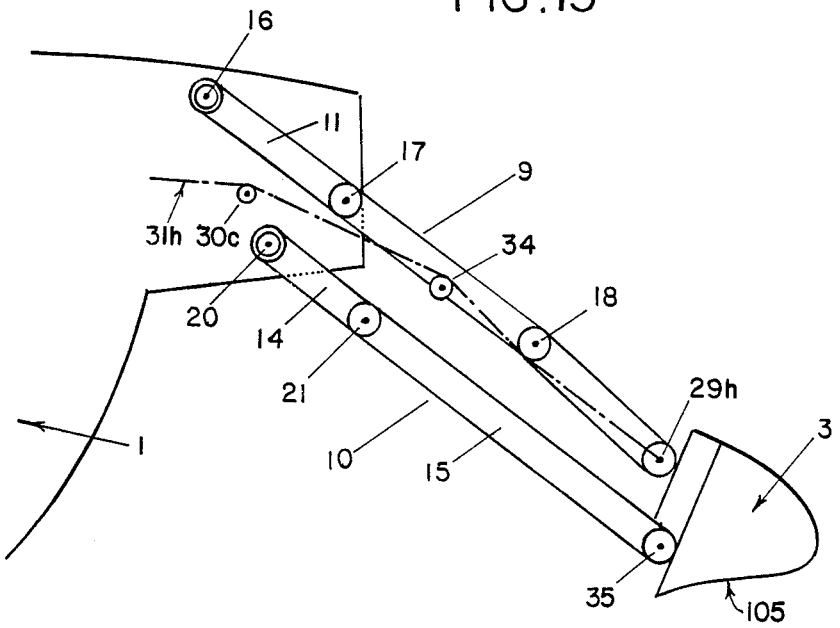
FIG. 13 is a cross-sectional view of a float arm assembly with the float connected pivotally to both upper and lower arms and rotatable around a longitudinal axis to bring a hydroplaning surface into engagement with the water.

In an extension of the present invention, a much higher degree of freedom for rotation of the float about its longitudinal axis is achieved by adding an additional pivot connection 35 between the lower arm and the float. An attractive application of this is the ability to bring a hydroplaning surface 105 on or compromising the inboard side of a float 3 gradually into action. This is illustrated in FIG. 13 in a cross-sectional view of a trimaran according to the invention, to which has been added lower arm outboard pivot connection 35 at the outer end of arm segment 15. The general function of auxiliary control line 31*h*, as shown in FIG. 13, is to inhibit the "upward buckling" of upper arm 9 around internal joints 17 and 18 and thus to limit the "upward buckling" of lower arm 10 around internal joint 21, which would normally occur with the operation of rigging control lines 31 and 32 (not shown) in lowering the float as described in reference to FIG. 7. The result of this action is to cause a force on float 3 which will rotate it upward at the respective outer pivot connections 29*h* and 35 of upper and lower float arms 9 and 10 as the float arms are rotated downward around their respective inner pivot connections 16 and 20 to the center section in response to the principal action of float lowering rigging 32. To achieve and maintain the orientation of arm segments for this application, it is required that upper and lower arm inner segments 11 and 14 be allowed to rotate below their horizontal positions and additional rigging control line 31*h* or other equivalent additional control means, such as hydraulic piston connected between arm segment 15 and float 3, must be introduced. The general function of auxiliary control line 31*h*, as shown in FIG. 13, is to inhibit the "upward buckling" of upper arm 9 around internal joints 17 and 18 and thus to limit the "upward buckling" of lower arm 10 around internal joint 21, which would normally occur with the operation of rigging control lines 31 and 32 (not shown) in lowering the float as described in reference to FIG. 7. The result of this action is to cause a force on float 3 which will rotate it upward at the respective outer pivot connections 29*h* and 35 of upper and lower float arms 9 and 10 as the float arms are rotated downward around their respective inner pivot connections 16 and 20 to the center section in response to the principal action of float lowering rigging 32.

Figure 14:
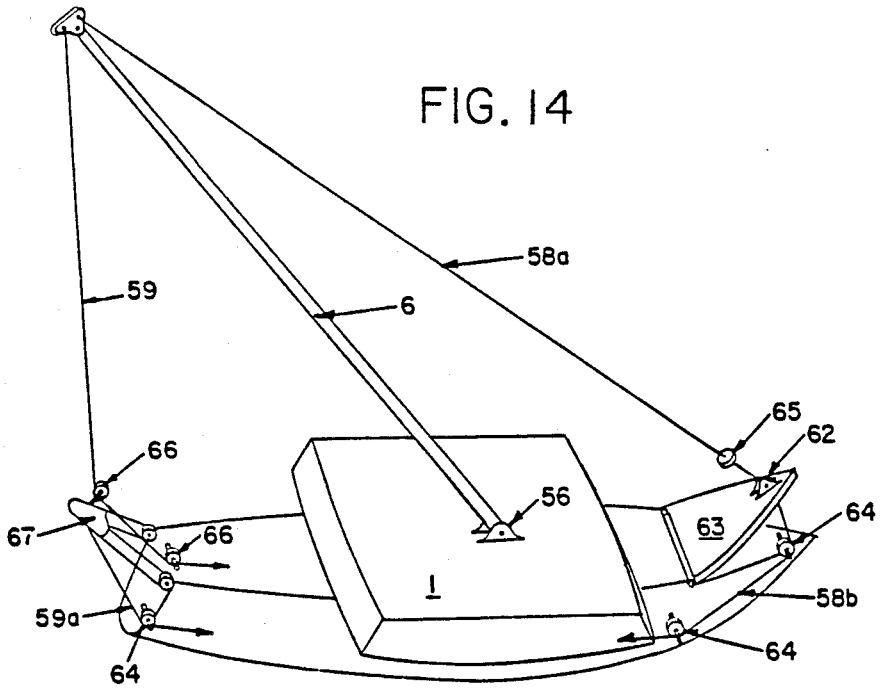
FIG. 14 is a simplified and somewhat schematic perspective view of the center hull of a trimaran according to the invention, illustrating means in the form of triangular frames pivoting along their respective bases on the main hull for the purpose of extending the leverage on the mast applied by the fore and aft stays above the deck or beyond the length of the mail hull.

FIG. 14 shows in a perspective view of a tramaran according to the invention a method for changing the angle of the mast with the vertical in which either fore or aft mast stays of either fixed or variable length could be stepped on the apexes of triangular supports which are pivotally connected around axes along the base of these triangles transverse to the centerline of the vessel and in which rigging from the underside of such triangular supports could be used to control the height of the apexes of such triangles and hence the effective length of the mast stays. In one embodiment of such a modification, forestay 58*a* of fixed length is stepped at a point 62 on the apex of triangular support 63, which lies parallel and flush with the fore deck of center section 1 when the mast 6 is in its normal vertical position and rigging 58*b* from the underside of triangular support 63 is led via tension directing pulleys 64 within the center section to a winch or other means (not shown) for adjusting the length of line 58*b*. The principal use for such a pivotable base for forestay 58*a* is to provide a means to keep the triangle between the mast and the forestay from completely collapsing as the mast is lowered to the deck and thus to provide leverage for re-raising the mast. The use of such fixed length forestays 58*a* could make possible the use of roller reefing mechanism 65. In the other embodiment of such modification, backstay 59 of variable length is led via tension redirecting pulleys 66 at the apex of triangular support 67 and in the center section 1 to a winch or other means (not shown) for adjusting its length. The triangular support 67 in this modification extends aftward from the stern of the center section 1 and is used primarily to extend the base of the triangle between the mast 6 and the backstay 59, but rigging 59*a*, which is led from the underside of a triangular support 67 via tension redirecting pulleys 64 to a winch or other means (not shown) for adjusting the length of line 59*a* and which is used to control the height of the apex of triangle 67, provides alternate means for adjusting the effective length of backstay 59.

Figure 15:
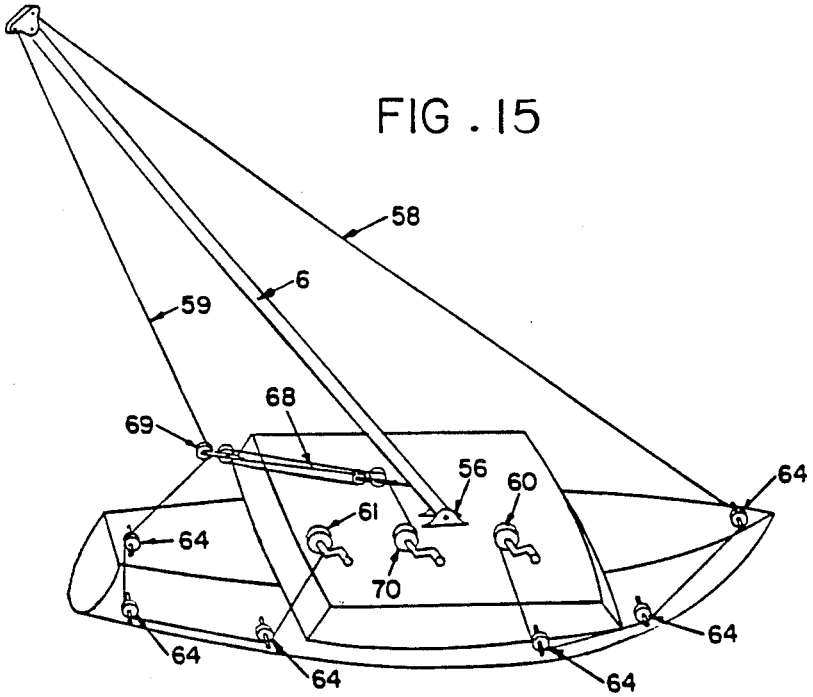
FIG. 15 shows in similar perspective view alternate means for effectively shortening the length of the mast stays and for bringing the inboard termination of the control means to a central location.

FIG. 15 shows in similar perspective view of center hull 1 and mast 6 with forestay 58 and backstay 59, led via tension redirecting pulleys 64 to centrally located winches 60 and 61, as described for FIG. 14, alternate means for changing the effective length of backstay 59 in the form of block and tackle 68, extending between pulley 69, which rides on the backstay 59, and a point near the base of the mast 6 with the fall of block and tackle 68 being led to winch 70. Without changing the actual length of backstay 59, as accomplished using the primary method described for FIG. 14, the triangle between mast 6 and backstay 59 can be collapsed by shortening block and tackle 68. This alternate arrangement provides better leverage as well as better mechanical advantage (useful when the vessel is capsized) than the primary method of shortening backstay 59 as the triangle between mast and backstay becomes nearly collapsed and the head of the mast extends substantially beyond the end of the vessel. An additional advantage is that backstay 59 remains fixed in length so that the mast 6 could be easily restored to the same trim angle when the forestay 58, which would have to be allowed to lengthen as the mast 6 is lowered, is shortened again to its former length. When not in use, block and tackle 68 could be relaxed or released from pulley 69 and stowed on deck. A similar arrangement could be used for the forestay 58 if it is desired to lower the mast 6 toward the bow.

It has been assumed for the method of raising/lowering floats 2 and 3 in conjunction with lowering/raising the mast 6 that the length of the float shrouds 8 would be kept fixed, at least during the operation. If the lengths of said shrouds are also made variable under crew control, with the extensions of variable-length float shrouds 8*a* being led via pulleys on or in the floats 2 and 3 and thence to winches or equivalent devices in or on the floats or in the center section, the manipulations of mast angle and float height with respect to the center section can be made independent of each other at crew discretion. The effective length of float shrouds 8*a* could be decreased by such means to raise the floats without changing the angle of the mast if the mast stays are not released. If, on the other hand, the mast is lowered to the deck in a capsize recovery as the means for raising the floats above the deck, the winches for controlling float shroud 8*a* could then be released so that the mast could be left on deck while the floats are independently relowered. If the float-lowering rigging 31 is not released, the mast can then be lowered/raised independently by operating the means for adjusting the length of these shrouds. Variable length float shrouds 8*a* would have a further function of permitting the lowering of floats 2 and 3 past their normal laterally extended positions without the necessity of releasing said shrouds.

Figure 16:
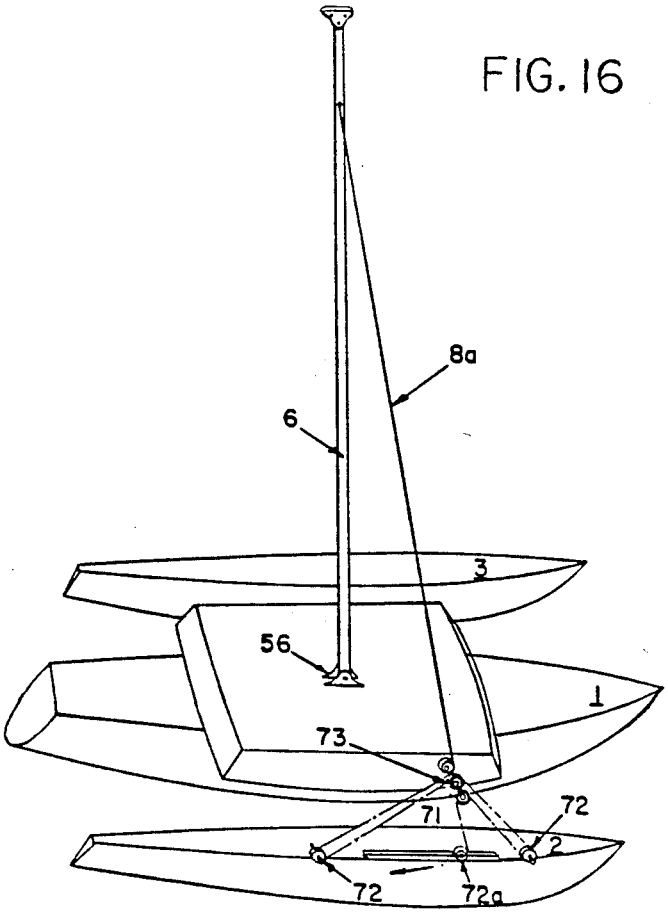
FIG. 16 shows in a simplified, somewhat schematic perspective view of a trimaran according to the invention means for adjusting the length and effective point of connection on the floats of the float shrouds.

FIG. 16 shows in simplified perspective view of a trimaran according to the invention, the center hull 1, floats 2 and 3, mast 6 and one float shroud 8a employing block and tackle arrangement 71 to vary the effective length of shroud 8a between a point on mast 6 and float 2. Block and tackle configuration 71 is connected at a plurality of points along the length of float 2 by single pulley blocks 72. The upper block 73 consists of a plurality of pulleys, one for each float deck pulley 72, and the shroud 8a is led in turn around each of the pulleys of block 73 to one or the pulleys 72. The fall of block and tackle 71, which is the extension of shroud 8a, is led via tension directing pulleys or other means (not shown) from one of these deck pulleys 72a to a winch or other means for adjusting its length from a central location. Block 73 is suspended between its points of connection on float 2 and mast 6 at a location in which a balance of forces will be maintained in the plane of the rigging. As the angle of the mast 6 with the vertical is altered or the length of the shroud 8a is varied, both the effective length of an equivalent fixed shroud 8 and the effective point at which it would step on the float 2 may vary. By appropriate location of pulleys 72 along the float 2, an improved relationship between upward force and longitudinal force can thus be realized throughout the whole range of angles which mast 6 can assume with respect to the vertical, as compared to an arrangement with a fixed single point of connection to the float 2. Not only can the upward component of tension exerted by the mat 6 on shroud 8a be increased relative to the longitudinal component; the twisting moment on float 2 can be reduced. Additional control over this relationship can be obtained by placing any of the pulleys 72 on a sliding track, as illustrated schematically for pulley 72a, so that its fore and aft position can be adjusted. If the change in float height for a given change in mast angle with no change in shroud length is not sufficient for the given location of the set of pulleys 72, the distance from any of the pulleys 72 or from the mast 6 to block 73 can be constrained in an alternate embodiment of block and tackle configuration 71 by replacing or supplementing the segment in question of shroud 8a with one of fixed length or by otherwise replacing any of the pulleys 72 or 73 with a fixed termination for shroud 8a or now-separated lengths of tackle in the block and tackle arrangement 71.

Figure 17:
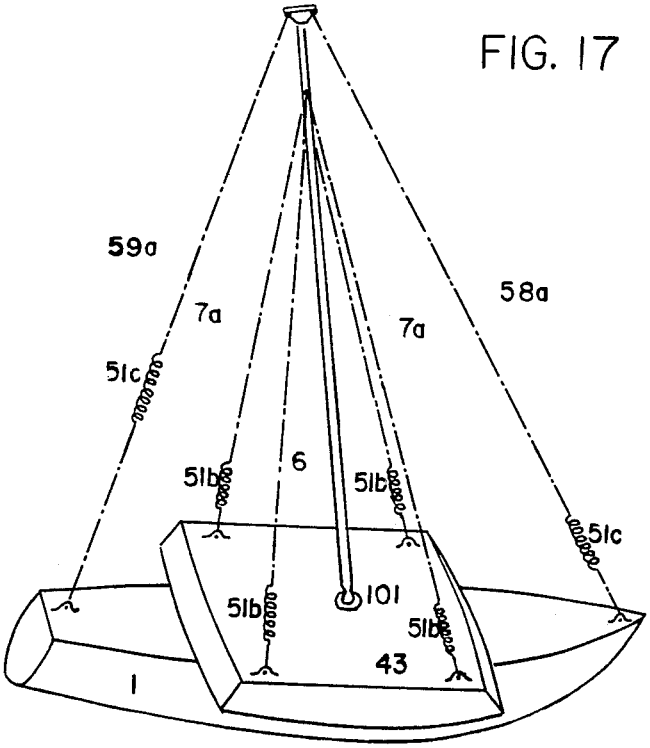
FIG. 17 shows, in a simplified, somewhat schematic perspective view of the center hull and pivotally mounted mast of a trimaran according to the invention, shrouds and stays with contained resilient means for permitting the mast to pivot away from a vertical orientation in any direction.

FIG. 17 shows, in a simplified, somewhat schematic perspective view of the center section 1 and pivotally connected mast 6 of a trimarin according to the invention, shrouds 7a and stays 58a and 59a between the mast and the center section, resilient means 51b and 51c contained within the shrouds and stays to permit the mast to pivot away from the vertical in any direction in response to forces of the wind on the sailplan and mast pivot connection 101 to the center section comprising a ball-and-socket joint or other universal type joint.

Figure 18:
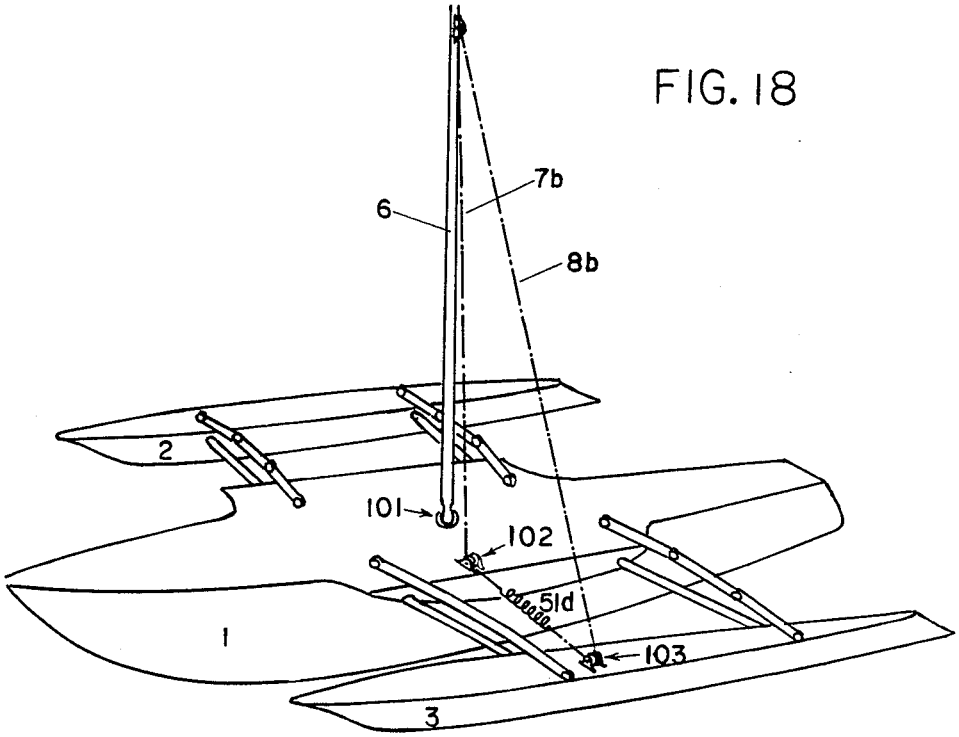
FIG. 18 shows, in a simplified, somewhat schematic perspective view of the center hull, floats and a pivotally mounted mast of a trimaran according to the invention, an interconnected system of shrouds between the mast, the center section and one float with resilient means for adjusting the length of both shrouds.

FIG. 18 shows in a simplified, somewhat schematic perspective view of the center section 1, floats 2 and 3 and pivotally connected mast 6 of a trimaran according to the invention a system comprising shroud 7b between the mast and the center section, shroud 8b between the mast and float 3 and resilient means 51d interconnected between shrouds 7b and 8b via pulleys 102 and 103 on the center section and on the floats, respectively, for adjusting the length of both float and center section shrouds in response to adjustments in float and mast positions. An identical system on the port side of the vessel is not shown. In a variation of this system, pivots 102 could be situated anywhere on the center section; in particular, they could be located on the sides of the center section opposite the floats with which they are associated.

Figure 19:
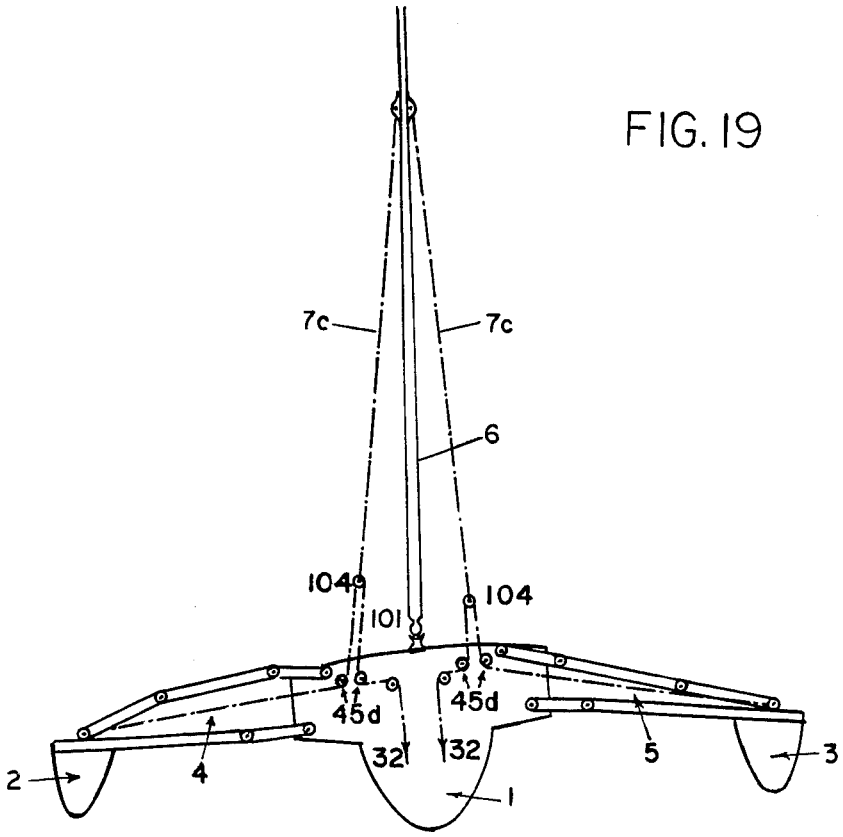
FIG. 19 is a cross-sectional view of a trimaran according to the invention showing an embodiment of an interconnection between float control rigging and shrouds of a pivotally connected mast interactively adjusting with changes in mast and float positions.

FIG. 19 is a simplified cross-sectional view of an embodiment of a trimaran according to the invention showing an interconnection between float control rigging lines 32 and shrouds 7c of a mast 6 pivotally connected to the center section, permitting interactive adjustments in mast and float positions. The interconnection is effected with the shrouds 7c terminating in floating pulleys 104 at their connection with rigging lines 32, the floating pulleys riding on said rigging lines and drawing them vertically between tension redirecting pulleys 45d to take up slack in the lines until a balance of forces is achieved. In a variation of this embodiment, shrouds 7c could be interactively connected with rigging lines 31 or 32 associated with the floats on the opposite sides of the center from their associated shrouds, the float control lines being either float-lowering rigging 31 or float-raising rigging 32.

What is claimed is:

1. A multihull vessel comprising:

a center section;

a plurality of float arm assemblies disposed on opposite sides of the center section and pivotably connected to the center section for movement between:

a first position laterally extended from the center section to increase the stability of the vessel in an upright position, a second position located upwardly and inwardly from the first position above the center section and closely adjacent the vertical centerline of the vessel when the vessel is in an upright position, to decrease the stability of the vessel when the vessel is in a fully capsized position; and a third position located downwardly and inwardly from the first position to reduce the beam of the vessel, each float arm assembly including upper arm means and lower arm means pivotably connected to the center section for pivotal movement;

the upper arm means including inner and outer segment means pivotably connected together about a first intermediate pivot, the inner segment means including an inner end pivotably connected to the center section, the lower arm means including inner and outer segment means connected together about a second intermediate pivot, the outer segment means of the lower arm means connected to a float and being pivotably connected to an outer end of said outer segment means of said upper arm means, the inner segment means of the lower arm means being pivotably connected to the center section, the outer segment means of the upper arm means being rotatable relative to the inner segment about the first intermediate pivot to shorten the effective length of the upper arm means as the float arm assembly is moved between its first and second positions, the outer segment of the lower arm means being rotatable relative to the inner segment about the second intermediate pivot to shorten the effective length of the lower arm means as the float arm assembly is moved between its first and third positions, and actuating means for pivoting the float arm assembly, comprising:

lifting means for moving the float arm assembly from its first portion to its second position comprising a rigging line extending between the center section and to one of said outer segments at a location adjacent said float, the line disposed below the first intermediate pivot and above the second intermediate pivot and arranged such that the lifting force applied to said one outer segment has a larger component in the horizontal direction than in the vertical direction, a lowering means for moving the float arm assembly from its first position to its third position, the lowering means extending between the upper and lower arm means and connected to the upper arm means, means for tensioning the rigging line for effecting movement of the float toward the center section when not opposed by the lowering means, means for tensioning the lowering means for reducing the separation between the upper and lower arm means when not opposed by the lifting means, and the rigging line engaging an underside of the first intermediate pivot to resist downward movement of the latter as the float assembly is being maintained in its first position.

2. Apparatus according to claim 1, wherein the additional rigging lines of at least two of the float arm assemblies are part of a continuous rigging line means extending therebetween.

3. Apparatus according to claim 1, wherein the lowering means comprises an additional rigging line extending from the center section and passing beneath the second intermediate pivot.

4. Apparatus according to claim 1, wherein the lowering means comprises an additional rigging line extending from the center section and passing beneath the second intermediate pivot.

5. Apparatus according to claim 4, wherein the additional rigging line terminates at the outer segment means of the upper arm means.

6. Apparatus according to claim 1, wherein said outer segment means of said lower arm means includes a pivotable leg which is also pivotably mounted to said outer segment means of said upper arm means, said float being carried by said leg.

7. Apparatus according to claim 1 including a mast pivotably mounted on the center section, the first rigging lines of the float arm assemblies being operably connected to the mast such that rotation of the mast produces a tensioning of at least one rigging line and a slackening of at lest one other rigging line.

8. Apparatus according to claim 1, wherein the rigging lines of at least two of the float arm assemblies are part of a commonly controllable continuous rigging line means extending therebetween.

9. Apparatus according to claim 1, wherein the lowering means comprises an additional rigging line, the additional rigging lines of at least two of the float arm assemblies are part of a continuous rigging line means extending therebetween.

10. Apparatus according to claim 1 including a mast pivotably mounted on the center section, the rigging lines of the float arm assemblies being operably connected to the mast such that rotation of the mast produces a tensioning of at least one rigging line and a slackening of at least one other rigging line.

11. Apparatus according to claim 1, wherein said outer segment means of said lower arm means includes a pivotable leg which is also pivotably mounted to said outer segment means of said upper arm means, said float being carried by said leg.

12. Apparatus according to claim 1, wherein said rigging line also engages a topside of the second intermediate pivot to resist upward movement thereof when the float arm assembly is being maintained in said first position.

13. Apparatus according to claim 1, wherein the first rigging lines of at least two of the float arm assemblies are part of a commonly controllable continuous rigging line means extending therebetween.

14. A multihull vessel comprising:

a center section;

a plurality of float arm assemblies disposed on opposite sides of the center section and pivotably connected to the center section for movement between:

a first position laterally extended from the center section to increase the stability of the vessel in an upright position, a second position located upwardly and inwardly from the first position above the center section and closely adjacent the vertical centerline of the vessel when the vessel is in an upright position, to decrease the stability of the vessel when the vessel is in a fully capsized position; and a third position located downwardly and inwardly from the first position to reduce the beam of the vessel, each float arm assembly including upper arm means and lower arm means pivotably connected to the center section for pivotal movement;

the upper arm means including inner and outer segment means pivotably connected together about a first intermediate pivot, the inner segment means including an inner end pivotably connected to the center section, the lower arm means including inner and outer segment means connected together about a second intermediate pivot, the outer segment means of the lower arm means connected to a float and being pivotably connected to an outer end of said outer segment means of said upper arm means, the inner segment means of the lower arm means being pivotably connected to the center section, the outer segment means of the upper arm means being rotatable relative to the inner segment about the first intermediate pivot to shorten the effective length of the upper arm means as the float arm assembly is moved between its first and second positions, the outer segment of the lower arm means being rotatable relative to the inner segment about the second intermediate pivot to shorten the effective length of the lower arm means as the float arm assembly is moved between its first and third positions, and actuating means for pivoting the float arm assembly, comprising:

lifting means for moving the float arm assembly from its first portion to its second position comprising a rigging line extending between the center section and to one of said outer segments at a location adjacent said float, the line disposed below the first intermediate pivot and above the second intermediate pivot and arranged such that the lifting force applied to the outer segment means of the lower arm means has a larger component in the horizontal direction than in the vertical direction, a lowering means for moving the float arm assembly from its first position to its third position, the lowering means extending between the upper and lower arm means and connected to the upper arm means, means for tensioning the rigging line for effecting movement of the float toward the center section when not opposed by the lowering means, means for tensioning the lowering means for reducing the separation between the upper and lower arm means when not opposed by the lifting means, and the rigging line, in the first and second positions of the float arm assembly, extending entirely within a space disposed between axes of rotation of the first and second intermediate pivots before terminating adjacent the float.

15. Apparatus according to claim 14, wherein the rigging lines of at least two of the float arm assemblies are part of a commonly controllable continuous rigging line means extending therebetween.

16. Apparatus according to claim 14, wherein the lowering means comprises an additional rigging line, the additional rigging lines of at least two of the float arm assemblies are part of a continuous rigging line means extending therebetween.

17. Apparatus according to claim 14 including a mast pivotably mounted on the center section, the rigging lines of the float arm assemblies being operably connected to the mast such that rotation of the mast produces a tensioning of at least one rigging line and a slackening of at least one other rigging line.

18. Apparatus according to claim 14, wherein the outer segment means of said lower arm means includes a pivotable leg which is also pivotably mounted to said outer segment means of said upper arm means, said float being carried by said leg.

19. Apparatus according to claim 14, wherein the rigging line extends in a substantially straight path from the center section to said location adjacent said float, when said float arm assembly is in the first position.

20. Apparatus according to claim 14, wherein the lowering means comprises an additional rigging line extending from the center section.

21. Apparatus according to claim 14, wherein the rigging line engages an underside of the first intermediate pivot to resist downward movement of the latter as the float arm assembly is being maintained in its first position.

22. A multihull vessel comprising:

a center section;

a plurality of float arm assemblies disposed on opposite sides of the center section and pivotably connected to the center section for movement between:

a first position laterally extended from the center section to increase the stability of the vessel in an upright position, a second position located upwardly and inwardly from the first position above the center section and closely adjacent the vertical centerline of the vessel when the vessel is in an upright position, to decrease the stability of the vessel when the vessel is in a fully capsized position; and a third position located downwardly and inwardly from the first position to reduce the beam of the vessel, each float arm assembly including upper arm means and lower arm means pivotably connected to the center section for pivotal movement;

the upper arm means including inner and outer segment means pivotably connected together about a first intermediate pivot, the inner segment means including an inner end pivotably connected to the center section, the lower arm means including inner and outer segment means connected together about a second intermediate pivot, the outer segment means of the lower arm means connected to a float and being pivotably connected to an outer end of said outer segment means of said upper arm means, the inner segment means of the lower arm means being pivotably connected to the center section, the outer segment means of the upper arm means being rotatable relative to the inner segment about the first intermediate pivot to shorten the effective length of the upper arm means as the float arm assembly is moved between its first and second positions, the outer segment of the lower arm means being rotatable relative to the inner segment about the second intermediate pivot to shorten the effective length of the lower arm means as the float arm assembly is moved between its first and third positions, and actuating means for pivoting the float arm assembly, comprising:

lifting means for moving the float arm assembly from its first position to its second position comprising a first rigging line extending between the center section and to one of said outer segments at a location adjacent said float, the first rigging line disposed below the first intermediate pivot and above the second intermediate pivot and arranged such that the lifting force applied to the outer segment means of the lower arm means has a larger component in the horizontal direction than in the vertical direction, a lowering means comprising an additional rigging line extending from the center section and between and in engagement with the upper and lower arm means for moving the float arm assembly from its first position to its third position, means for tensioning the first rigging line for effecting movement of the float toward the center section when not opposed by the lowering means, and means for tensioning the second rigging line for reducing the separation between the upper and lower arm means when not opposed by the lifting means.

23. Apparatus according to claim 22, wherein the first rigging line, in the first and second positions of the float arm assembly, extends entirely within a space disposed between axes of rotation of the first and second intermediate pivots before terminating at the outer segment means of the lower arm means.

24. Apparatus according to claim 22, wherein each of the first and second rigging lines contains resilient means within the length thereof for permitting an increase in the effective length of the rigging line and adjustment of the relative orientation of said arm segment means of all float assemblies in reaction to increased external force.

25. Apparatus according to claim 22 including primary float position control means located in the center section for applying force to the first-named rigging lines of all said float assemblies.

26. Apparatus according to claim 25 including auxiliary float position control means located in the center section and being separately connected to the first-named rigging line of each float assembly to permit independent adjustment in length thereof.

27. Apparatus according to claim 26 including resilient means connected to the auxiliary float position control means, permitting individual adjustment in length of the first-named rigging lines in reaction to different and variable external forces applied to the respective float arm assemblies.

28. Apparatus according to claim 25 including resilient float position control means located in the center section and connected between a pair of the first rigging lines associated with a pair of float assemblies to permit mutual and interactive adjustments in length thereof in reaction to variable external force being applied.

29. Apparatus according to claim 25 including resilient float position control means located in the center section and connected separately to the first rigging lines associated with each float arm assembly to permit individual adjustment in length thereof in reaction to variable external force being applied.

* * * * *